US009857705B2

(12) United States Patent
Tanaka

(10) Patent No.: US 9,857,705 B2
(45) Date of Patent: Jan. 2, 2018

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventor: Masato Tanaka, Tagata-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/291,183

(22) Filed: Oct. 12, 2016

(65) Prior Publication Data

US 2017/0115582 A1 Apr. 27, 2017

(30) Foreign Application Priority Data

Oct. 23, 2015 (JP) ..... 2015-209160

(51) Int. Cl.
*G03G 5/14* (2006.01)
*G03G 5/08* (2006.01)
*G03G 21/18* (2006.01)

(52) U.S. Cl.
CPC ..... *G03G 5/08* (2013.01); *G03G 21/18* (2013.01)

(58) Field of Classification Search
CPC ..... G03G 5/142; G03G 5/14
See application file for complete search history.

(56) References Cited

U.S. PATENT DOCUMENTS 5,194,353 A 3/1993 Tanaka et al.
5,246,807 A 9/1993 Kanemaru et al.
5,453,342 A 9/1995 Go et al.
5,464,718 A 11/1995 Kashizaki et al.
5,527,653 A 6/1996 Tanaka
5,629,116 A 5/1997 Kashizaki et al.
5,666,589 A 9/1997 Yoshinaga et al.
5,811,212 A 9/1998 Tanaka
5,818,489 A 10/1998 Yoshinaga et al.
6,040,100 A 3/2000 Tanaka et al.
6,139,997 A 10/2000 Tanaka et al.
6,183,922 B1 2/2001 Takai et al.
6,190,811 B1 2/2001 Tanaka et al.
6,218,063 B1 4/2001 Tanaka et al.
6,248,490 B1 6/2001 Suzuki et al.
(Continued)

FOREIGN PATENT DOCUMENTS

JP S58-095351 6/1983
JP 2007-524672 8/2007
(Continued)

OTHER PUBLICATIONS

Aizawa, et al., "Solution-processed multilayer small-molecule light-emitting devices with high-efficiency white-light emission", Nature Communications, vol. 5, No. 5756 (2014) 1-7.

*Primary Examiner* — Hoa V Le

(74) *Attorney, Agent, or Firm* — Fitzpatrick Cella Harper and Scinto

(57) ABSTRACT

An electrophotographic photosensitive member includes an electroconductive support, and an intermediate layer, charge generation layer containing a charge generation material, and a charge transport layer containing a charge transport material sequentially disposed on the electroconductive support, wherein the intermediate layer contains a compound having two or more diarylphosphine oxide structures and a resin.

12 Claims, 2 Drawing Sheets

(56) References Cited

U.S. PATENT DOCUMENTS

| | | | |
|---|---|---|---|
| 6,270,936 | B1 | 8/2001 | Tanaka et al. |
| 6,335,132 | B1 | 1/2002 | Tanaka et al. |
| 6,472,524 | B2 | 10/2002 | Tanaka |
| 6,773,856 | B2 | 8/2004 | Tanaka et al. |
| 6,833,227 | B2 | 12/2004 | Tanaka |
| 7,245,851 | B2 | 7/2007 | Fujii et al. |
| 7,333,752 | B2 | 2/2008 | Kawahara et al. |
| 7,517,626 | B2 | 4/2009 | Fujii et al. |
| 7,910,274 | B2 | 3/2011 | Tanaka et al. |
| 8,088,541 | B2 | 1/2012 | Tanaka et al. |
| 8,415,078 | B2 | 4/2013 | Tanaka et al. |
| 8,481,236 | B2 | 7/2013 | Tanaka et al. |
| 8,617,777 | B2 | 12/2013 | Tanaka |
| 8,841,052 | B2 | 9/2014 | Watariguchi et al. |
| 8,865,381 | B2 | 10/2014 | Tanaka et al. |
| 8,936,892 | B2 | 1/2015 | Kaku et al. |
| 8,974,991 | B2 | 3/2015 | Kawahara et al. |
| 9,068,083 | B2 | 6/2015 | Tanaka et al. |
| 9,217,938 | B2 | 12/2015 | Tanaka |
| 9,223,233 | B2 | 12/2015 | Tanaka |
| 9,244,369 | B2 | 1/2016 | Tanaka et al. |
| 9,348,242 | B2 | 5/2016 | Tanaka |
| 9,436,106 | B2 | 9/2016 | Kuno et al. |
| 9,442,399 | B2 | 9/2016 | Tanaka |
| 9,459,542 | B2 | 10/2016 | Tanaka et al. |
| 9,459,545 | B2 | 10/2016 | Tanaka et al. |
| 9,500,965 | B2 | 11/2016 | Tanaka |
| 9,500,966 | B2 | 11/2016 | Watariguchi et al. |
| 2014/0141362 | A1 | 5/2014 | Watariguchi et al. |
| 2015/0093693 | A1 | 4/2015 | Watariguchi et al. |
| 2015/0301461 | A1 | 10/2015 | Tanaka |
| 2015/0309426 | A1 | 10/2015 | Nishida et al. |
| 2015/0316863 | A1 | 11/2015 | Tanaka et al. |
| 2015/0316864 | A1 | 11/2015 | Kuno et al. |
| 2015/0346616 | A1 | 12/2015 | Kawahara et al. |
| 2015/0346617 | A1 | 12/2015 | Kawahara et al. |
| 2015/0362847 | A1 | 12/2015 | Tanaka et al. |
| 2016/0091807 | A1 | 3/2016 | Tanaka et al. |
| 2016/0124328 | A1 | 5/2016 | Kawahara et al. |
| 2016/0131985 | A1 | 5/2016 | Tanaka et al. |
| 2016/0139516 | A1 | 5/2016 | Kawahara et al. |
| 2016/0154326 | A1 | 6/2016 | Kumoi et al. |
| 2016/0154328 | A1 | 6/2016 | Kumoi et al. |

FOREIGN PATENT DOCUMENTS

| | | |
|---|---|---|
| JP | 2012-27323 | 2/2012 |
| WO | 2005/073340 | 8/2005 |
| WO | 2012/085983 | 6/2012 |

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to electrophotographic photosensitive members, process cartridges, and electrophotographic apparatuses. The present invention particularly relates to an electrophotographic photosensitive member including an intermediate layer, and a process cartridge and an electrophotographic apparatus including such an electrophotographic photosensitive member.

Description of the Related Art

Organic electrophotographic photosensitive members have advantages over conventional inorganic electrophotographic photosensitive members on its harmlessness, readiness in production, and great freedom in functional design because of a variety of constitutional materials to be selected. Such organic electrophotographic photosensitive members have been broadly used in, the market with recent rapid spread of laser beam printers.

The organic photosensitive member often includes an intermediate layer disposed between an electroconductive support and a photosensitive layer to cover defects on the electroconductive support, give adhesiveness to the photosensitive layer, prevent interference fringes, protect electrical breakage of the photosensitive layer, and prevent injection of holes from the electroconductive support to the photosensitive layer (see Japanese Patent Application Laid-Open No. S58-95351).

The intermediate layer has such advantages while having disadvantages: For example, charges are readily accumulated in the intermediate layer. The charges accumulated in the intermediate layer significantly fluctuate potential during continuous printing, causing image deficits. For example, if an organic photosensitive member having such an intermediate layer is used in development process widely used in printers at present in which dark potential portions are non-developed portions and bright potential portions are developed portions (so-called reversal development system), the sensitivity of portions exposed to light during the previous print may be increased by a reduced bright potential or residual potential, causing a ghost phenomenon (positive ghost) to significantly appear that the previous print portions appear as black portions on a solid white image output during the next print. Conversely, the sensitivity of portions exposed to light during the previous print may be reduced by an increased bright potential, causing a so-called ghost phenomenon (negative ghost) to significantly appear that the previous print portions appear as white portions on a solid black image output during the next print.

A variety of methods for reducing a fluctuation in potential caused by an increase in residual potential or a reduction in initial potential and the like to enhance durability are proposed in continuous print using an organic photosensitive member including an intermediate layer. Unfortunately, these methods cause many problems such as a reduction in initial sensitivity or charging ability, and these problems remain unsolved yet.

A recent trend toward high-quality color images has been increasing severe requirements for the photosensitive member. A photosensitive member which does not change properties due to an environmental variation in use and does not cause a fluctuation in potential and image deterioration such as ghost when used under severe environments is desired.

As one of methods for solving these problems, a method of adding metal oxide and a monophosphine oxide compound to an intermediate layer to improve a fluctuation in potential under an environment of normal temperature and low humidity is proposed. It cannot be said yet, however, that this method provides an intermediate layer perfectly satisfying the requirements for use under severe environments of high humidity/high temperature and low humidity deteriorating the durability of the photosensitive member (see Japanese Patent Application Laid-Open No. 2012-27323).

Although examples are found in which a compound represented by the formula (1) (described later) used in the present invention is used in EL elements, use of this compound in the intermediate layer of the organic photosensitive member is not described (see Japanese Patent. Application Laid-Open No. 2007-524672).

SUMMARY OF THE INVENTION

The present inventors, who have conducted extensive research to solve the problems above, have focused on the intermediate layer disposed on the electroconductive support of the electrophotographic photosensitive member. The present inventors have found that the intermediate layer containing a specific compound can significantly reduce a fluctuation in potential on the surface of the photosensitive member under any environment to stably form high-quality images under a variety of environments for a long time, and have completed the present invention.

Namely, the present invention is as follows:

(1) An electrophotographic photosensitive member including, in this order, an electroconductive support, an intermediate layer, a charge generation layer containing a charge generation material, and a charge transport layer containing a charge transport material, the intermediate layer containing a resin and a compound having two or more diarylphosphine oxide structures.

(2) The electrophotographic photosensitive member according to (1), wherein the compound having two or more diarylphosphine oxide structures is a compound represented by formula (1)

(1)

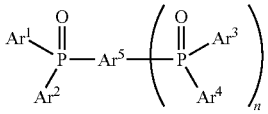

wherein $Ar^1$ to $Ar^4$ each independently represent an aromatic hydrocarbon group having an optional substituent; and n represents 1 or 2, and when n is 1, $Ar^5$ represents a divalent aromatic hydrocarbon group having an optional substituent, and when n is 2, $Ar^5$ represents a trivalent aromatic hydrocarbon group having an optional substituent; and the optional substituent of the aromatic hydrocarbon group in $Ar^1$ to $Ar^5$ is a halogen atom, an alkyl group having 1 to 4 carbon atoms, a methoxy group, an ethoxy group, a dimethylamino group, a diethylamino group, or a diphenylphosphine oxide group.

(3) The electrophotographic photosensitive member according to (2) wherein $Ar^5$ is a terphenylene group.

(4) The electrophotographic photosensitive member according to (1), wherein the resin is a polyamide resin.

(5) The electrophotographic photosensitive member according to (4), wherein the polyamide resin is a polyamide resin containing a dimer acid residue having 36 to 44 carbon atoms as a dicarboxylic acid component.

(6) The electrophotographic photosensitive member according to (1), wherein the mass ratio of the content of the compound having two or more diarylphosphine oxide structures to the content of the resin in the intermediate layer is 2:8 to 6:4.

(7) The electrophotographic photosensitive member according to (1), wherein the charge generation material is gallium phthalocyanine crystal.

(8) The electrophotographic photosensitive member according to (7), wherein the gallium phthalocyanine crystal is hydroxygallium phthalocyanine crystal having peaks at 7.4°±0.3° and 28.3°±0.3° in CuKα characteristic X-ray diffraction pattern (Bragg angle 2θ).

(9) The electrophotographic photosensitive member according to (8), wherein the hydroxygallium phthalocyanine crystal having peaks at 7.4°±0.3° and 28.3°±0.3° in CuKα characteristic X-ray diffraction pattern (Bragg angle 2θ) contains N,N-dimethylformamide and/or N-methylformamide in the crystal.

(10) The electrophotographic photosensitive member according to (9), wherein the total content of N,N-dimethylformamide and/or N-methylformamide contained in the gallium phthalocyanine crystal is 0.5 mass % or more and 1.7 mass % or less of gallium phthalocyanine in the gallium phthalocyanine crystal.

(11) A process cartridge integrally supporting the electrophotographic photosensitive member according to any one of (1) to (10), and at least one unit selected from the group consisting of a charging unit, a developing unit, and a cleaning unit, and detachably mountable on a main body of an electrophotographic apparatus.

(12) An electrophotographic apparatus including the electrophotographic photosensitive member according to any one of (1) to (10), a charging unit, an exposing unit, a developing unit, and a transferring unit.

Further features of the present invention will become apparent from the following description of exemplary embodiments with reference to the attached drawings.

DESCRIPTION OF THE EMBODIMENTS

Figure 1:
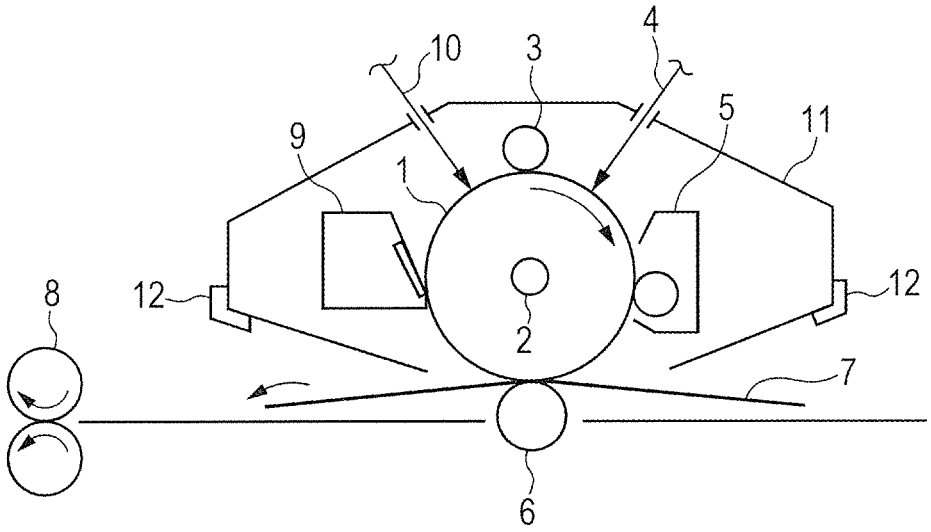
FIG. 1 is a diagram illustrating an example of a schematic configuration of an electrophotographic apparatus including a process cartridge including an electrophotographic photosensitive member according to the present invention.

Preferred embodiments of the present invention will now be described in detail in accordance with the accompanying drawings.

The present invention has been made in consideration of these conventional techniques described above, and an object of the present invention is to provide an electrophotographic photosensitive member which has durability and can form high-quality images having no image defects and no fluctuation in color nuance caused by a fluctuation in image density through minimization of a fluctuation in bright potential under environments having different temperatures and humidities such as environments at normal, temperature and normal humidity, at high temperature and hitch humidity, and at low temperature and low humidity, and a process cartridge and an electrophotographic apparatus including the electrophotographic photosensitive member.

An embodiment of the present invention will now be described in detail.

As described above, the present invention is as follows:

(1) An electrophotographic photosensitive member including, in this order, an electroconductive support, an intermediate layer, a charge generation layer containing a charge generation material, and a charge transport layer containing a charge transport material, the intermediate layer containing a resin and a compound having two or more diarylphosphine oxide structures.

(2) The electrophotographic photosensitive member according to (1), wherein the compound having two or more diarylphosphine oxide structures is a compound represented by formula (1):

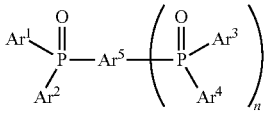

(1)

wherein $Ar^1$ to $Ar^4$ each independently represent an aromatic hydrocarbon group having an optional substituent; and n represents 1 or 2, and when n is 1, $Ar^5$ represents a divalent aromatic hydrocarbon group having an optional substituent, and when n is 2, $Ar^5$ represents a trivalent aromatic hydrocarbon group having an optional substituent; and the optional substituent of the aromatic hydrocarbon group in $Ar^1$ to $Ar^5$ is a halogen atom, an alkyl group having 1 to 4 carbon atoms, a methoxy group, an ethoxy group, a dimethylamino group, a diethylamino group, or a diphenylphosphine oxide group.

(3) The electrophotographic photosensitive member according to (2) wherein $Ar^5$ is a terphenylene group.

(4) The electrophotographic photosensitive member according to (1), wherein the resin is a polyamide resin.

(5) The electrophotographic photosensitive member according to (4), wherein the polyamide resin is a polyamide resin containing a dimer acid residue having 36 to 44 carbon atoms as a dicarboxylic acid component.

(6) The electrophotographic photosensitive member according to (1), wherein the mass ratio of the content of the compound having two or more diarylphosphine oxide structures to the content of the resin in the intermediate layer is 2:8 to 6:4.

(7) The electrophotographic photosensitive member according to (1), wherein the charge generation material is gallium phthalocyanine crystal.

(8) The electrophotographic photosensitive member according to (7), wherein the gallium phthalocyanine crystal is hydroxygallium phthalocyanine crystal having peaks at 7.4°±0.3° and 28.3°±0.3° in CuKα characteristic X-ray diffraction pattern (Bragg angle 2θ).

(9) The electrophotographic photosensitive member according to (8), wherein the hydroxygallium phthalocyanine crystal having peaks at 7.4°±0.3° and 28.3°±0.3° in CuKα characteristic X-ray diffraction pattern (Bragg angle 2θ) contains N,N-dimethylformamide and/or N-methylformamide in the crystal.

(10) The electrophotographic photosensitive member according to (9), wherein the total content of N,N-dimethylformamide and/or N-methylformamide contained in the gallium phthalocyanine crystal is 0.5 mass % or more and 1.7 mass % or less of gallium phthalocyanine in the gallium phthalocyanine crystal.

(11) A process cartridge integrally supporting the electrophotographic photosensitive member according to any one of (1) to (10), and at least one unit selected from the group consisting of a charging unit, a developing unit, and a cleaning unit, and detachably mountable on a main body of an electrophotographic apparatus.

(12) An electrophotographic apparatus including the electrophotographic photosensitive member according to any one of (1) to (10), a charging unit, an exposing unit, a developing unit, and a transferring unit.

The electrophotographic photosensitive member of the present invention includes an electroconductive support, and a photosensitive layer composed of at least three layers of an intermediate layer disposed on the electroconductive support, and a charge generation layer containing a charge generation material, and a charge transport layer containing a charge transport material disposed on the intermediate layer. In this configuration of the electrophotographic photosensitive member of the present invention, the intermediate layer contains a compound having two or more diarylphosphine oxide structures and a resin.

Among the compounds having two or more diarylphosphine oxide structures used in the present invention, a compound represented by the formula (1) is preferred because a fluctuation in bright potential can be minimized under any environments having different temperatures and different humidities with durability, and a high effect of preventing image defects caused by a fluctuation in image density is provided.

A compound having a terphenylene group for $Ar^5$ in the formula (1) is particularly preferred because of a higher effect of preventing image defects caused by a fluctuation in image density.

Examples of the compounds suitably used in the present invention are shown below, but the present invention should not be limited to these compounds.

Exemplary compound (1)

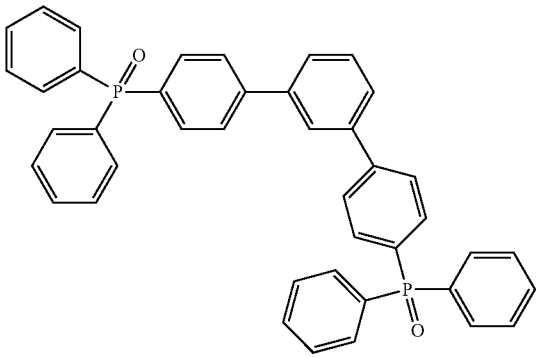

Exemplary compound (2)

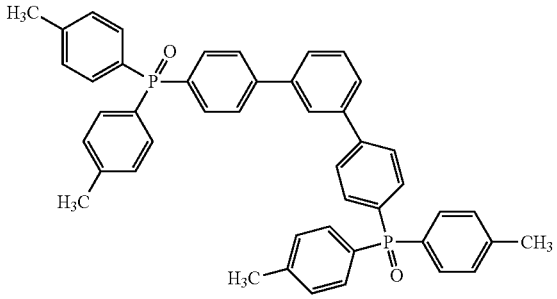

Exemplary compound (3)

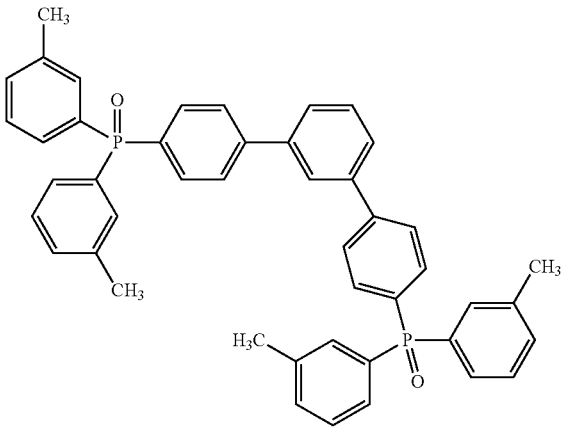

Exemplary compound (4)

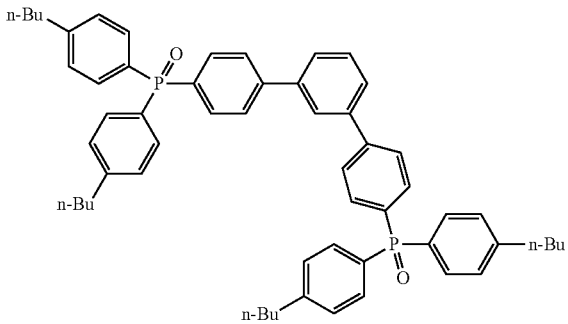

-continued
Exemplary compound (5)
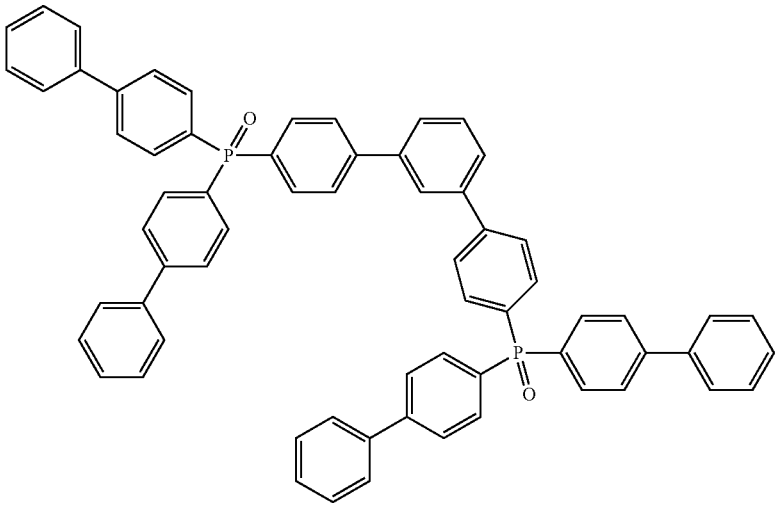
Exemplary compound (6)
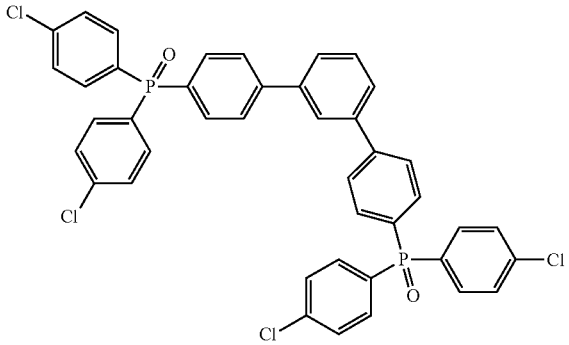
Exemplary compound (7)
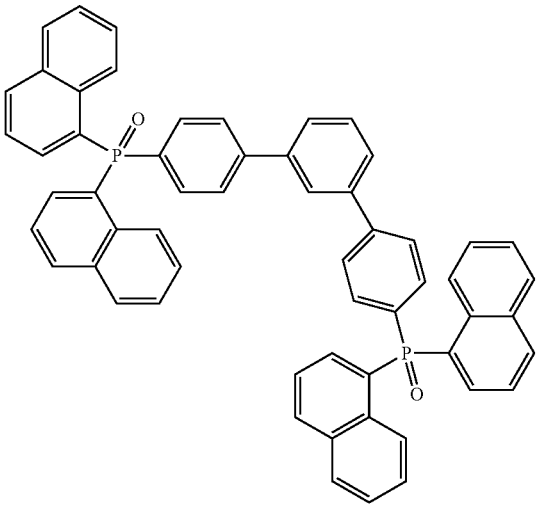
Exemplary compound (8)
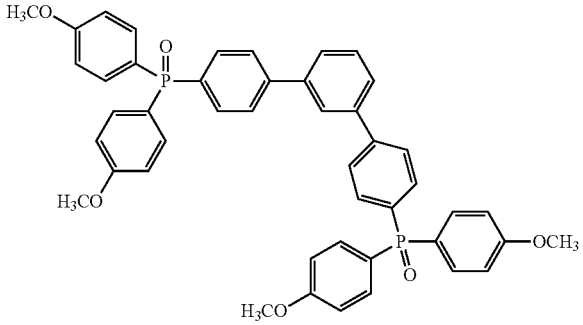
Exemplary compound (9)
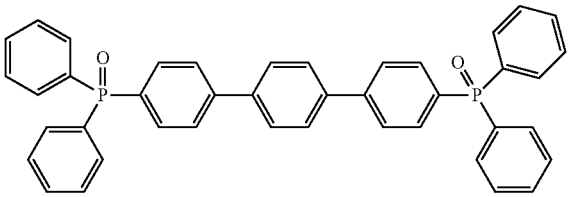
Exemplary compound (10)
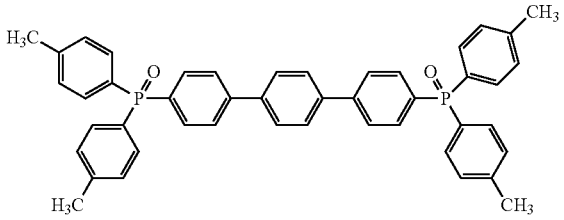
Exemplary compound (11)
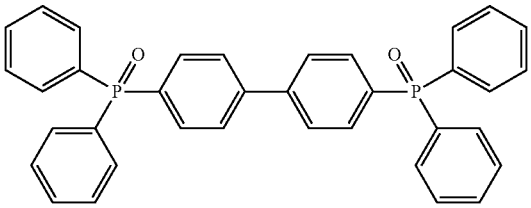

-continued
Exemplary compound (12)
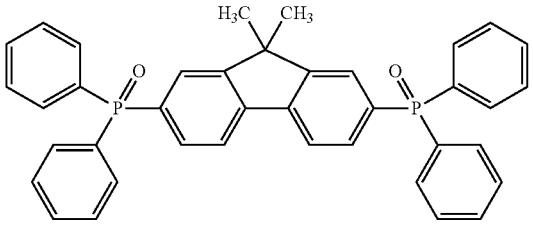
Exemplary compound (13)
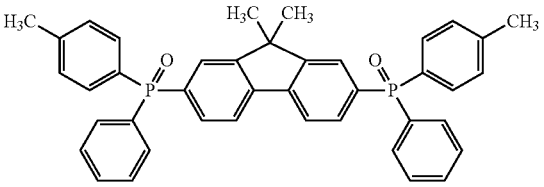
Exemplary compound (14)
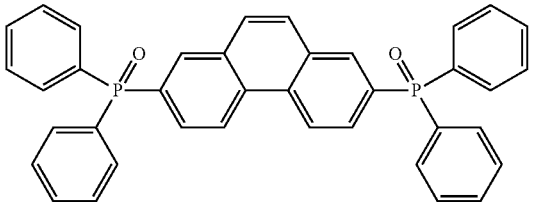
Exemplary compound (15)
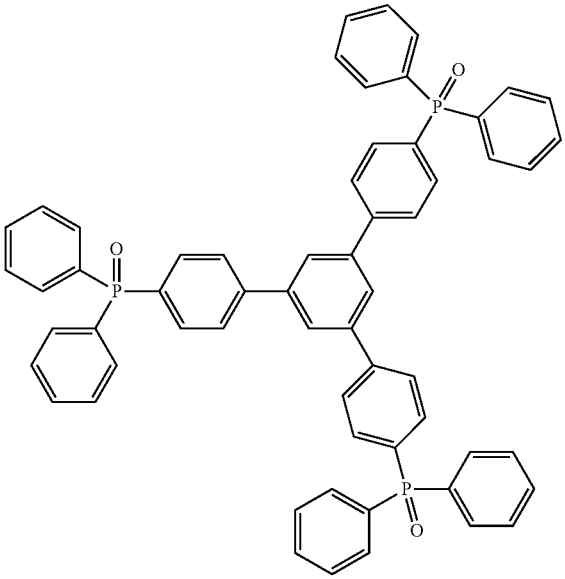
Exemplary compound (16)
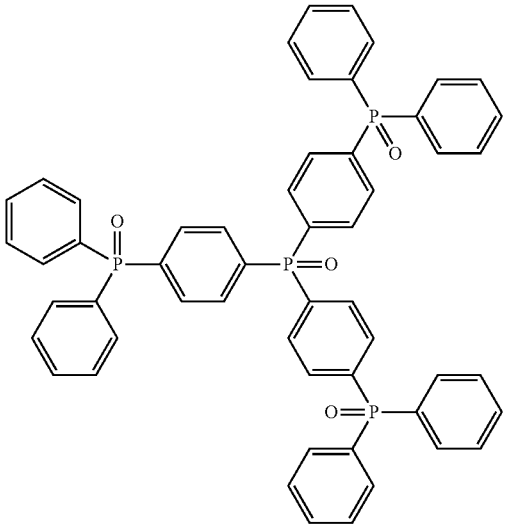
Exemplary compound (17)
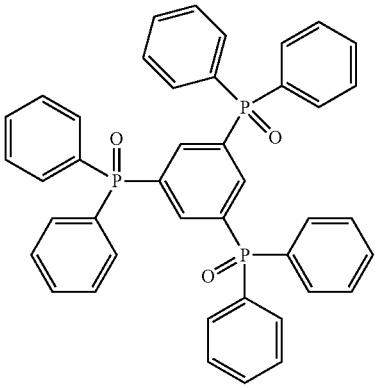

-continued

Exemplary compound (18)

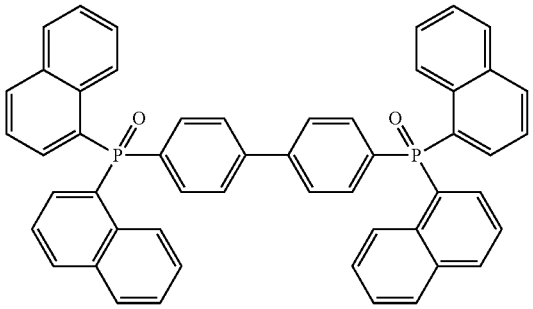

Exemplary compound (19)

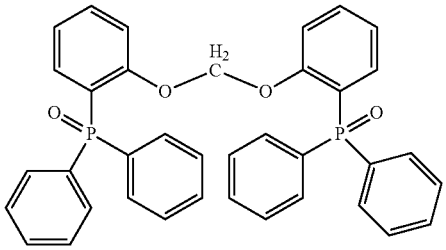

The electrophotographic photosensitive member of the present invention has a layer configuration composed of an intermediate layer containing at least a compound having two or more diarylphosphine oxide structures and a resin, the intermediate layer being disposed on the electroconductive support, a charge generation layer containing a charge generation material and a charge transport layer containing a charge transport material sequentially disposed the intermediate layer. Furthermore, an interference fringe preventing layer may be disposed between the intermediate layer and the electroconductive support, or a protective layer may be disposed on the charge transport layer when necessary.

Any electroconductive support having conductivity can be used. Examples thereof include electroconductive supports composed of metals such as aluminum, stainless steel and nickel, metals including a conductive layer, plastics, and paper. The electroconductive support is in the form of a cylinder or a film. Particularly a cylindrical aluminum electroconductive support is excellent in view of mechanical strength, electrophotographic properties, and cost. These electroconductive supports may be used as they are, or may be used after subjected to a physical treatment such as machining and honing or a chemical treatment such as anodic oxidation treatment or a treatment with an acid. Especially, use of an electroconductive support subjected to the physical treatment such as machining and honing to have a surface roughness Rz of 0.5 μm or more and 1.5 μm or less and thus an interference fringe preventing function provides high electrophotographic properties such as ghost. The electroconductive support more preferably has a surface roughness Rz of 0.6 μm or more and 1.2 μm or less.

Although an interference fringe preventing layer is unnecessary in the support having the interference fringe preventing function, an electroconductive support can be used as it is, and can be coated to form an interference fringe preventing layer. This simple method can give an interference fringe preventing function to the electroconductive support, and is very useful in view of Productivity and cost. Examples of a preferred method of forming an interference fringe preventing layer include a method of dispersing inorganic particles of tin oxide, indium oxide, titanium oxide, or barium sulfate and a curable resin such as a phenol resin or an urethane resin in an appropriate solvent to prepare a coating solution, and applying the coating solution onto an electroconductive support. The interference fringe preventing layer can have a thickness of 10 μm or more and 25 μm or less.

The intermediate layer is composed of at least a compound having two or more diarylphosphine oxide structures and a resin. This thin layer is prepared as follows: The compound having two or more diarylphosphine oxide structures and the resin are dissolved or dispersed in a solvent to prepare a coating solution, and the coating solution is applied onto an electroconductive support (or interference fringe preventing layer). Any binder resin can be used without limitation. For example, phenol resins, epoxy resins, polyurethane, polyimide, polyimide, polyamideimide, polyethylene, polyacrylamide, acrylonitrile-butadiene copolymer, polyvinyl chloride, melamine resins, or silicone resins are appropriately used. These resins can be used alone or in the form of a mixture. Among these resins, polyamide resins can be used in view of the miscibility of the compound having two or more diarylphosphine oxide structures in the resin. Among these resins, a polyamide resin containing dimer acid residues having 36 to 44 carbon atoms as a dicarboxylic acid component of the polyamide resin is particularly preferred because of a small change in volume resistance caused by a change in humidity. Examples of the polyamide resin containing dimer acid residues include PA-102A (moisture absorbing rate: 0.3%, made by T&K TOKA CO., LTD.), PA-105A (moisture absorbing rate: 0.3%, made by T&K TOKA CO., LTD.), Macromelt 6202 (moisture absorbing rate: 0.44%, made by Henkel Corporation), and Macromelt 6301 (moisture absorbing rate: 0.11%, made by Henkel Corporation).

The dimer acid of the present invention refers to a dimer of a fatty acid, which is prepared through dimerization of a raw material fatty acid by a Diels-Alder reaction. In the structural term, the dimer acid is classified into those having an alicyclic structure and those having side chains. The dimer acid is generally obtained as a mixture, thereof. A raw material fatty acid having 18 carbon atoms results in a dimer acid having 36 carbon atoms, and a raw material fatty acid having 22 carbon atoms results in a dimer acid having 44 carbon atoms. Examples of the dimer acid to be used include a dimer acid having 36 carbon atoms (trade name: Pripol 1009, made by Croda Japan K.K.), and a dimer acid having 44 carbon atoms (trade name: Pripol 1004, made by Croda Japan K.K.).

The intermediate layer may contain a conductive substance to control the volume resistance or the dielectric constant thereof. Examples of the conductive substance include metals such as aluminum powder and copper powder; metal oxide such as aluminum oxide, tin oxide, indium oxide, titanium oxide, zirconium oxide, zinc oxide, silicon oxide, tantalum oxide, molybdenum oxide, and tungsten oxide; organic metal compounds such as zirconium tetra-n-butoxide, titanium tetra-n-butoxide, aluminum isopropoxide, and methylmethoxysilane; and carbon black. Furthermore, a mixture thereof can also be used.

The content of the compound having two or more diarylphosphine oxide structures in the intermediate layer is preferably 10 mass % or more and 70 mass % or less, more preferably 20 mass % or more and 60 mass % or less relative to the total amount of the intermediate layer. A content of more than 70 mass % may result in poor applicability of the coating solution during formation of the intermediate layer or poor stability of the coating solution. A content of less than 10 mass % results in a significantly small content of the compound, and may reduce the effect of the compound. These compounds can be used alone or in the form of a mixture thereof.

The content of the resin in the intermediate layer is preferably 30 mass % or more and 90 mass % or less, more preferably 40 mass % or more and 80 mass % or less relative to the total amount of the intermediate layer. A content of less than 30 mass % is not preferred because it may reduce the applicability of the coating solution during formation of the intermediate layer or the stability of the coating solution.

The mass ratio of the content of the compound having two or more diarylphosphine oxide structures 70 the content of the resin in the intermediate layer can be the compound: resin=2:8 to 6:4 to demonstrate the applicability of the coating solution during formation of the intermediate layer or the stability of the coating solution.

The coating solution used for formation of the intermediate layer can be prepared through dissolution or dispersion of the compound having two or more diarylphosphine oxide structures and the resin in an appropriate solvent. Any solvent can be used in preparation of the coating solution without limitation. For example, toluene, xylene, ethyl acetate, methylal, methanol, ethanol, isopropyl alcohol, n-propyl alcohol, butyl alcohol, methyl cellosolve, and methoxypropanol can be used.

Examples of the application method include application methods such as dipping, spray coating, spinner coating, bead coating, blade coating, and beam coating. The intermediate layer to be formed has a thickness of Preferably about 0.3 μm or more and 10 μm or less, more preferably 0.5 μm or more and 5.0 μm or less.

The charge generation layer used in the electrophotographic photosensitive member of the present invention contains at least a charge generation material. Any known charge generation material conventionally used in the organic electrophotographic photosensitive member can be used in the present invention without limitation. An azo pigment or a phthalocyanine pigment can be used. As the phthalocyanine pigment, any phthalocyanine such as metal free phthalocyanine and metal phthalocyanine optimally having an axial ligand can be used. These phthalocyanines may have substituents. In particular, oxytitanium phthalocyanine and gallium phthalocyanine have high sensitivity while these phthalocyanines readily generate ghost. However, these phthalocyanines used in combination with the intermediate layer containing the compound having two or more diarylphosphine oxide structures and the resin can prevent, generation of ghost while maintaining high sensitivity, so that advantageous effects of the prevent invention can be more significantly demonstrated.

The gallium phthalocyanine used herein can have any crystal form. Among these phthalocyanines, hydroxygallium phthalocyanine crystals having strong peaks at 7.4°±0.3° and 2833°±0.3° (where the diffraction angle (Bragg angle) is 2θ in the chart obtained by CuKα characteristic X-ray diffraction) have particularly high sensitivity. Unfortunately, the gallium phthalocyanine readily generates a fluctuation in image density caused by an initial rapid fluctuation in bright potential under a low humidity environment. However, the gallium phthalocyanine used in combination with the in layer containing the compound having two or more diarylphosphine oxide structures and the resin can prevent generation of a fluctuation in image defects caused by an initial rapid fluctuation in bright potential while maintaining high sensitivity, so that advantageous effects of the prevent invention can be more significantly demonstrated. Among these gallium phthalocyanines, those in combination with hydroxygallium phthalocyanine crystals containing N,N-dimethylformamide and/or N-methylformamide in the crystals can more significantly demonstrate advantageous effects of the prevent invention. Furthermore, the total content of N,N-dimethylformamide and/or N-methylformamide contained in the hydroxygallium phthalocyanine crystals is particularly preferably 0.5 mass % or more and 1.7 mass % or less relative to the amount of hydroxygallium phthalocyanine in the hydroxygallium phthalocyanine crystals.

A method of preparing hydroxygallium phthalocyanine crystals containing N,N-dimethylformamide and/or N-methylformamide in the crystals will be described. The hydroxygallium phthalocyanine crystals containing N,N-dimethylformamide and/or N-methylformamide in the crystals are prepared by performing a crystal conversion step of preparing hydroxygallium phthalocyanine by acid pasting, and wet milling the hydroxygallium phthalocyanine with N,N-dimethylformamide and/or N-methylformamide.

In the present invention, the resulting gallium phthalocyanine crystal is analyzed from the data obtained in the NMR measurement to determine whether the hydroxygallium phthalocyanine crystal contains an amide compound represented by the formula (1) and N,N-dimethylformamide in the crystals.

The hydroxygallium phthalocyanine crystals undergo X-ray diffraction and NMR measurements on the following conditions.

[Measurement by Powder X-Ray Diffraction]

Apparatus used: X-ray diffractometer RINT-TTRII made by Rigaku Denki K.K.

X-ray tube: Cu
Tube voltage: 50 KV
Tube current: 300 mA
Scanning method: 2θ/θ scanning
Scanning rate: 4.0°/min
Sampling interval: 0.02°
Start angle (2θ): 5.0°
Stop angle (2θ): 40.0°
Attachment: standard sample holder
Filter: not used
Incident monochrometer: used
Counter monochrometer: not used
Divergence slit: opened
Divergence vertical limit slit: 10.00 mm
Scattering slit: opened
Receiving slit: opened
Flat plate monochrometer: used
Counter: scintillation counter.

[NMR Measurement]

Apparatus used: AVANCEIII 500 made by BRUKER Corporation

Nucleus species for measurement: $^1H$
Solvent: bisulfuric acid ($D_2SO_4$).

The charge transport layer included in the electrophotographic photosensitive member of the present invention contains at least a charge transport material. Any known charge transport material conventionally used in the organic electrophotographic photosensitive member can be used in the present invention without limitation. Examples thereof include triarylamine compounds, hydrazone compounds, stilbene compounds, pyrazoline compounds, oxazole compounds, thiazole compounds, triallylmethane compounds, enamine compounds, and butadiene compounds.

The charge generation layer can be formed as follows: The charge generation material is dissolved or dispersed in an appropriate solvent with an appropriate binder resin. The resulting coating solution is applied onto the intermediate layer, and the coating is dried. The charge transport layer is also formed as follows: A coating solution composed of mainly the charge transport material and a binder resin dissolved in a solvent is applied onto the charge generation layer, and the coating is dried. The same solvent and the same binder resin as those listed in preparation of the coating solution for the intermediate layer can be used in preparation of the coating solution for the photosensitive layer. The same application method as that listed in formation of the intermediate layer is used in formation of the photosensitive layer.

The charge generation layer has a thickness of preferably 0.1 μm or more and 1 μm or less, particularly preferably 0.15 μm or more and 0.4 μm or less. The charge transport layer has a thickness of preferably 5 μm or more and 40 μm or less, particularly preferably 10 μm or more and 30 μm or less.

A protective layer disposed on the charge transport layer when necessary in the present invention can be formed as follows: A resin such as polyvinyl butyral, polyester, polycarbonate (such as polycarbonate or modified polycarbonate), nylon, polyimide, polyarylate, polyurethane, styrene-butadiene copolymer, styrene-acrylic acid copolymer, and styrene-acrylonitrile copolymer is dissolved in an appropriate organic solvent, the resulting coating solution is applied onto the photosensitive layer, and the coating is dried; or the coating solution is applied onto the photosensitive layer, and is cured with heating, electron beams, or ultraviolet light. The protective layer can have a thickness of 0.05 μm or more and 20 μm or less.

The protective layer may contain conductive particles, an ultraviolet absorbing agent, and lubricant particles such as fluorine atom-containing resin nanoparticles. Preferred conductive particles are metal oxide particles such as tin oxide particles.

FIG. 1 is a diagram illustrating one example of a schematic configuration of an electrophotographic apparatus including a process cartridge including the electrophotographic photosensitive member of the present invention.

A cylindrical (drum-shaped) electrophotographic photosensitive member 1 is driven to rotate around an axis 2 in the arrow direction at a predetermined circumferential speed (process speed).

The surface of the electrophotographic photosensitive member 1 is charged to a predetermined positive or negative potential by a charging unit 3 while the electrophotographic photosensitive member 1 is rotating. The charged surface of the electrophotographic photosensitive member 1 is irradiated with image exposure light 4 from an image exposing unit (not illustrated) to form an electrostatic latent image according to the information on the target image. The image exposure light 4 is, for example, slit exposure light or laser beam scanning exposure light output from an image exposing unit, and the intensity thereof is modulated according to the temporal electric digital image signals corresponding to the information on the target image.

The electrostatic latent image formed on the surface of the electrophotographic photosensitive member 1 is developed with a toner accommodated in a developing unit 5 (normal development or reversal development) to form a toner image on the surface of the electrophotographic photosensitive member 1. The toner image formed on the surface of the electrophotographic photosensitive member 1 is transferred onto a transfer material 7 by a transferring unit 6. At this time, a bias voltage having a polarity opposite to that of the charges retained in the toner is applied to the transferring unit 6 by a bias power supply (not illustrated). If the transfer material 7 is paper, the transfer material 7 is taken out from a sheet feeding unit (not illustrated), and is fed between the electrophotographic photosensitive member 1 and the transferring unit 6 synchronizing with rotation of the electrophotographic photosensitive member 1.

After the toner image is transferred from the electrophotographic photosensitive member the transfer material 7 is separated from the surface of the electrophotographic photosensitive member 1, and is sent to an image fixing unit 8 to fix the toner image. The transfer material 7 is then output as an image forming product (print, copy) to the outside of the electrophotographic apparatus.

After the toner image is transferred onto the transfer material 7, the surface of the electrophotographic photosensitive member 1 is cleaned by a cleaning unit 9 through removal of adhering substances such as the toner (transfer residual toner), a cleanerless system recently developed, the transfer residual toner can also be directly removed with a developing unit. The surface of the electrophotographic photosensitive member 1 is discharged with pre-exposure light 10 from a pre-exposing unit (not illustrated), and is repeatedly used in image formation, the charging unit 3 is a contact charging unit including a charging roller, the pre-exposing unit is not always needed.

In the present invention, among the components described above such as the electrophotographic photosensitive member 1, the charging unit 3, the developing unit 5, and the cleaning unit 9, a plurality of components can be accommodated in a container, and can be integrally supported to forma process cartridge. The process cartridge can be configured to be detachably mountable on the main body of an electrophotographic apparatus. For example, the electrophotographic photosensitive member 1 and at least one unit selected from the charging unit 3, the developing unit 5, and the cleaning unit 9 can be integrally supported to form a process cartridge 11 detachably mountable on the main body of the electrophotographic apparatus with a guiding unit 12 disposed in the electrophotographic apparatus, such as a rail.

The image exposure light 4 may be reflected light or transmitted light from a manuscript if the electrophotographic apparatus is a copier or a printer. The image exposure light 4 may also be light emitted as a result of scanning with laser beams, drive of LED arrays, or drive of liquid crystal shutter arrays according to the signals obtained from reading the manuscript with a sensor.

The electrophotographic photosensitive member 1 of the present invention can be broadly used in applications or the electrophotographic field such as laser beam printers, CRT printers, LED printers, FAX machines, liquid crystal printers, and laser plate making.

EXAMPLES

The present invention will now be described in more detail by way of specific Examples. The present invention will not be limited these. In the electrophotographic photosensitive members in Examples and Comparative Examples, the thickness of each layer was determined with an eddy current thickness meter (Fischerscope, made by Fischer Technology, Inc.), or was determined from the mass per unit area in terms of specific gravity.

Synthetic Example 1

Under an atmosphere in the stream of nitrogen, phthalonitrile (5.46 parts) and α-chloronaphthalene (45 parts) were placed in a reaction tank, and were heated to a temperature of 30° C. This temperature was kept. Next, gallium trichloride (3-75 parts) was added at this temperature (30° C.). At this time, the moisture content of the mixed solution was 150 ppm. Subsequently, the mixed solution was heated to a temperature of 200° C. Next, under an atmosphere in the stream of nitrogen, the mixed solution was reacted at a temperature of 200° C. for 4.5 hours, and was cooled. When the temperature reached 150° C., the product was filtered. The filtered product was dispersed in N,N-dimethylformamide for washing at a temperature of 140° C. for two hours. The solution was then filtered. The filtered product was washed with methanol, and was dried to prepare a chlorogallium phthalocyanine pigment (4.65 parts, yield: 71%).

Synthetic Example 2

The chlorogallium phthalocyanine pigment (4.65 parts) prepared in Synthetic Example 1 was dissolved in concentrated sulfuric acid (139.5 parts) at a temperature of 10° C. The solution was added dropwise to ice water (620 parts) with stirring to be again deposited. The solution was filtered with a filter press. The resulting wet cake (filtered product) was dispersed in 2% aqueous ammonia for washing. The solution was filtered with a filter press. The resulting wet cake (filtered product) was then dispersed in deionized water for washing, and the solution was filtered with a filter press. This operation was repeated three times to prepare a hydroxygallium phthalocyanine pigment (hydrous hydroxygallium phthalocyanine pigment) (18.6 parts, yield 95%) having 23% solid content.

Next, 6.6 kg of the hydroxygallium phthalocyanine pigment (hydrous hydroxygallium phthalocyanine pigment) was dried with a hyperdry dryer (trade name: HD-06R, frequency (oscillating frequency): 2455 MHz±15 MHz, made by Nippon Biocon K.K.) according to the following procedure.

The hydroxygallium phthalocyanine pigment was placed on a dedicated circular plastic tray as it was, i.e., the solid state extracted from the filter press (thickness of the hydrous cake: 4 cm or less). The dryer was set such that far-infrared radiation was off, and the temperature of the inner wall of the dryer was 50° C. During microwave irradiation, the vacuum pump and the leak valve were adjusted to control the degree of vacuum to 4.0 kPa or more and, 10.0 kPa or less.

In step 1, the hydroxygallium phthalocyanine pigment was irradiated with 4.8 kW microwave for 50 minutes. Next, the microwave was once turned off, and the leak valve was once closed to attain a high vacuum state of 2 kPa or less. At this time, the solid content of the hydroxygallium phthalocyanine pigment was 88%.

In step 2, the leak valve was adjusted to control the degree of vacuum (dryer inner pressure) within the set value (4.0 kPa or more and 10.0 kPa or less). The hydroxygallium phthalocyanine pigment was irradiated with 1.2 kW microwave for 5 minutes. The microwave was once turned off, and the leak valve was once closed to attain a high vacuum state at 2 kPa or less. This operation of step 2 was repeated once more (twice in total). At this time, solid content of the hydroxygallium phthalocyanine pigment was 98%.

In step 3, the hydroxygallium phthalocyanine pigment was irradiated with a microwave in the same manner as in step 2 except that the output of the microwave of step 2 was changed from 1.2 kW to 0.8 kW. This operation of step 3 was repeated once more (twice in total).

In step 4, the leak valve was adjusted to return the degree of vacuum (dryer inner pressure) within the set value (4.0 kPa or more and 10.0 kPa or less). The hydroxygallium phthalocyanine pigment was irradiated with 0.4 kW microwave for 3 minutes. The microwave was once turned off, and the leak valve was once closed to attain a high vacuum state at 2 kPa or less. This operation of step 4 was further repeated 7 times (8 times in total).

A hydroxygallium phthalocyanine pigment having a moisture content of 1% or less was prepared in three hours in total (1.52 kg).

Preparative Example 1

Figure 2:
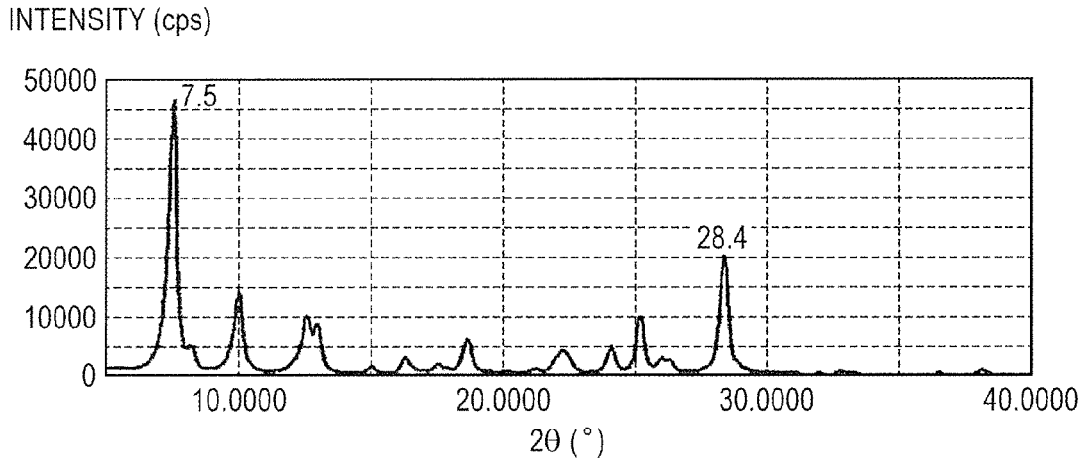
FIG. 2 is a powder X-ray diffraction pattern of the hydroxygallium phthalocyanine crystal used in Example 1 as a charge generation material.

The hydroxygallium phthalocyanine pigment (0.5 parts) prepared in Synthetic Example 2, N,N-dimethylformamide (10 parts), and glass beads (20 parts) having a diameter of 0.8 mm were milled with a ball mill at room temperature (23° C.) and 60 rpm for 48 hours. The resulting dispersion liquid was filtered to separate gallium phthalocyanine crystals. The gallium phthalocyanine crystals on the filter were sufficiently washed with tetrahydrofuran. This filtered product was vacuum dried to prepare hydroxygallium phthalocyanine crystals (0.45 parts). The powder X-ray diffraction pattern of the crystals is shown in FIG. 2.

It was verified that the hydroxygallium phthalocyanine crystals prepared in this Preparative Example contained 2.1 mass % N,N-dimethylformamide, which was determined from the proton ratio obtained from NMR measurement. N,N-dimethylformamide is compatible with tetrahydrofuran, and it shows that N,N-dimethylformamide is contained in the hydroxygallium phthalocyanine crystals.

Preparative Example 2

Figure 3:
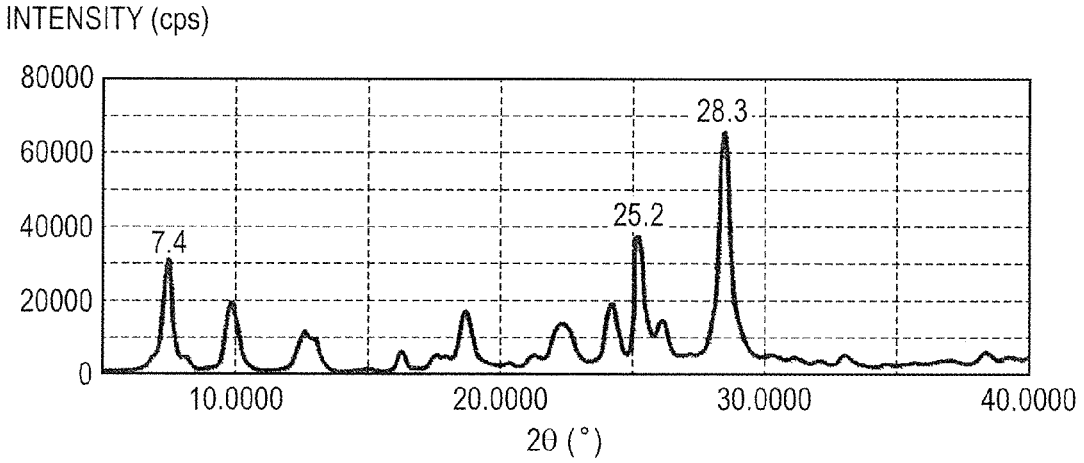
FIG. 3 is a powder X-ray diffraction pattern of the hydroxygallium phthalocyanine crystal used in Example 9 as a charge generation material.

The hydroxygallium phthalocyanine pigment (0.5 parts) prepared in Synthetic Example 2, N-methylformamide (10 parts), and glass beads (20 parts) having a diameter of 0.8 mm were milled with a ball mill at room temperature (23° C.) and 60 rpm for 200 hours. The resulting dispersion liquid was filtered to separate hydroxygallium phthalocyanine crystals. The hydroxygallium phthalocyanine crystals on the filter were sufficiently washed with tetrahydrofuran. This filtered product was vacuum dried to prepare hydroxygallium phthalocyanine crystals (0.46 parts). The powder X-ray diffraction pattern of the crystals is shown in FIG. 3.

It was verified that the hydroxygallium phthalocyanine crystals prepared in this Preparative Example contained 1.7 mass % N-methylformamide, which was determined from the proton ratio obtained from NMR measurement. N-methylformamide is compatible with tetrahydrofuran, and it shows that N-methylformamide is contained in the hydroxygallium phthalocyanine crystals.

Preparative Example 3

The hydroxygallium phthalocyanine pigment (0.5 parts) prepared in Synthetic Example 2, N-methylformamide (10 parts), and glass beads (20 parts) having a diameter of 0.8 mm were milled with a ball mill at room temperature (23° C.) and 60 rpm for 600 hours. The resulting dispersion liquid was filtered to separate hydroxygallium phthalocyanine crystals. The hydroxygallium phthalocyanine crystals on the filter were sufficiently washed with tetrahydrofuran. This filtered product was vacuum dried to prepare hydroxygallium phthalocyanine crystals (0.45 parts). The powder X-ray diffraction pattern of the crystals was similar to that of FIG. 3.

It was verified that the hydroxygallium phthalocyanine crystals prepared in this Preparative Example contained 0.9 mass % N-methylformamide, which was determined from the proton ratio obtained from NMR measurement. N-methylformamide is compatible with tetrahydrofuran, and it shows that N-methylformamide is contained in the hydroxygallium phthalocyanine crystals.

Example 1

A titanium oxide powder coated with tin oxide containing 10% antimony oxide (50 parts), a resol phenol resin (25 parts), methyl cellosolve (20 parts), methanol (5 parts), and silicone oil (polydimethylsiloxane.polyoxyalkylene copolymer, average molecular weight: 3000) (0.002 parts) were dispersed in a sand mill using glass beads having a diameter of 0.8 mm for 2 hours to prepare a coating solution for an interference fringe preventing layer. This coating solution was applied on to an aluminum cylinder (diameter: 24 mm, length: 261 mm) as an electroconductive support by immersion. The coating was dried at 140° C. for 30 minutes to form an interference fringe preventing layer having a thickness of 20 μm.

Next, Exemplary compound (1) (8 parts) and a copolymerized nylon resin (trade name: AMILAN CM8000, made by Toray Industries, Inc., 4 parts) and a methoxymethylated nylon 6 resin (trade name: TORESIN EF-30T, made by Nagase ChemteX Corporation, 8 parts) were dissolved in a mixed solvent of methanol (250 parts)/n-butanol (150 parts) to prepare a coating solution for an intermediate layer.

The coating solution for an intermediate layer was applied onto the interference fringe preventing layer by immersion. The coating was dried at 100° C. for 20 minutes to form an intermediate layer having a thickness of 0.75 μm.

Next, crystalline hydroxygallium phthalocyanine (crystals containing 2.1% N,N-dimethylformamide relative to the amount of the hydroxygallium phthalocyanine compound) (10 parts) prepared in Preparative Example 1 and having peaks at 7.4° and 28.4° in the chart obtained by CuKα characteristic X-ray diffraction, and a polyvinyl butyral resin (trade name: S-LEC BX-1, made by SEKISUI CHEMICAL CO., LTD., 5 parts) were added to cyclohexanone (200 parts). The solution was dispersed with a sand mill using glass beads having a diameter of 0.9 mm for 6 hours. Cyclohexanone (150 parts) and ethyl acetate (350 parts) were further added to dilute the solution. A coating solution for a charge generation layer was thereby prepared. The coating solution for a charge generation layer was applied onto the intermediate layer by immersion. The coating was dried at 95° C. for 10 minutes to form a charge generation layer having a thickness of 0.20 μm.

Next, a charge transport material represented by the following formula (2) (6 parts), a charge transport material (3 parts) represented by the following formula (3), and a polycarbonate resin (trade name: Iupilon Z-200, made by MITSUBISHI GAS CHEMICAL COMPANY, INC., 10 parts) were dissolved in monochlorobenzene (50 parts) and methylal (30 parts). The resulting solution was applied onto the charge generation layer by immersion. The coating was dried at 115° C. for 1 hour to form a charge transport layer having a thickness of 25 μm. Electrophotographic photosensitive member 1 was thereby prepared.

(2)

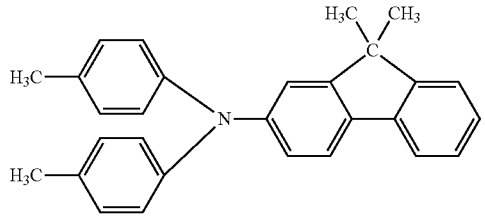

(3)

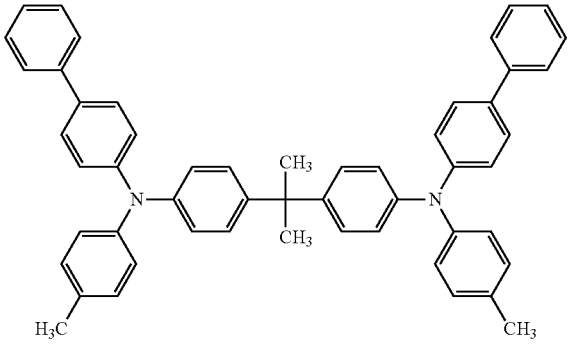

Electrophotographic photosensitive member 1 prepared above was used to evaluate a fluctuation in potential and ghost in images. The electrophotographic apparatus used for evaluation was a laser beam printer made by Hewlett-Packard Japan, Ltd. (trade name: Color Laser Jet CP3525dn), which was modified such that pre-exposure light was not lit, and the charging conditions and the intensity of the image exposure light were variable. The electrophotographic photosensitive member prepared above was mounted on a cyan process cartridge, and the process cartridge was attached to the station for the cyan process cartridge. The laser beam printer was also modified so as to operate unless the process cartridges for other colors were attached to the main body of the printer.

In output of images, only the cyan process cartridge was attached to the main body of the printer, and a monochromatic image was output using only a cyan toner.

First, under normal temperature and normal humidity (N/N) environment at a temperature of 23° C./humidity of 55% RH, the charging conditions and the intensity of the image exposure light were controlled such that the initial dark potential was −500 V and the bright potential was −100 V. In setting of the potentials, the surface potential of the drum-shaped electrophotographic photosensitive member was measured as follows: the cartridge was modified, a potential probe (trade name: model 60005-8, made by Trek Japan K.K.) was attached to the developing position, and the potential of the central portion of the cylindrical electrophotographic photosensitive member was measured with an electrostatic voltmeter (trade name: model 344, made by Trek Japan K.K.).

Subsequently, the ghost in images was evaluated on the same conditions. Subsequently, a test of repeated feeding of 1000 sheets was performed. Immediately after the test, the ghost in images was evaluated and the bright potential was measured. The results of evaluation under the normal temperature and normal humidity environment are shown an Table 1.

Next, the electrophotographic photosensitive member and the electrophotographic apparatus for evaluation were left under a low temperature and low humidity (L/L) environment at a temperature of 15° C./humidity of 10% RH for 3 days, and the bright potential was measured and the ghost in images was evaluated on the same conditions. A test of repeated feeding of 1000 sheets was performed on the same conditions. Immediately after the test, the ghost in images was evaluated and the bright potential was measured. The results of evaluation under a low temperature and low humidity environment are also shown in Table 1.

Next, the electrophotographic photosensitive member and the electrophotographic apparatus for evaluation were left under a high temperature high humidity (H/H) environment at a temperature of 30° C./humidity of 80% RH for one day, and the bright potential was measured and the ghost in images was evaluated on the same conditions. A test of repeated feeding of 1000 sheets was performed on the same conditions. Immediately after the test, the ghost in images was evaluated and the bright potential was measured. The results of evaluation under an environment at a high temperature and a high humidity are shown in Table 2.

In the test of repeated sheet feeding, a cyan monochromatic image of a letter E was printed on a plain paper of size A4 at a coverage rate of 1%.

The ghost in images was evaluated by the following method.

In evaluation of ghost in images, a solid white image was output on a first sheet. Subsequently, each of four ghost charts was output on one sheet (four sheets in total). Next, a solid black image was output on one sheet, and each of the four ghost charts were output on one sheet (four sheets in total), and 8 sheets in total was evaluated of the ghost in images. In the ghost chart, four solid black squares with 25 mm sides were aligned parallel to each other on a solid white background in the region from a print image writing position (10 mm from the upper end of the sheet) to 30 mm at equal intervals, and halftone images of four print patterns were output in the region after the region 30 mm from the print image writing position, and the outputs were ranked.

The four ghost charts indicates the charts having different halftone patterns in the region after the region 30 mm from the print image writing position. The following four halftone images were used:

(1) 1-dot and 1-space horizontal*print (laser exposure) pattern.

(2) 2-dot and 2-space horizontal*print (laser exposure) pattern.

(3) 2-dot and 3-space horizontal*print (laser exposure) pattern.

(4) Keima print (laser exposure) pattern. (pattern similar to the movement of Keima in Japanese chess, which is composed of 2 dots printed in 6 cells)

*: the term "horizontal" indicates the scanning direction of the laser scanner (horizontal direction of the sheet output.).

The ghost in images was ranked according to the following criteria. In Ranks 4, 5, and 6, it was determined that advantageous effects of the present invention are not sufficiently obtained.

Rank 1: no ghost is found in all of the ghost charts.

Rank 2: the ghost is slightly found in a certain ghost chart.

Rank 3: the ghost is slightly found in all of the ghost charts.

Rank 4: the ghost is found in a certain ghost chart.

Rank 5: the ghost is found in all of the ghost charts.

Rank 6: the ghost is clearly found in a certain ghost chart.

Example 2

An electrophotographic photosensitive member 2 was prepared by the same method as in Example 1 except that Exemplary compound (1) used for the intermediate layer in Example 1 was replaced with Exemplary compound (2). The electrophotographic photosensitive member 2 was evaluated in the same manner as in Example 1. The results of evaluation are shown in Tables 1 and 2.

Example 3

An electrophotographic photosensitive member 3 was prepared by the same method as in Example 1 except that. Exemplary compound (1) used for the intermediate layer in Example 1 was replaced with Exemplary compound (9). The electrophotographic photosensitive member 3 was evaluated in the same manner as in Example 1. The results of evaluation are shown in Tables 1 and 2.

Example 4

An electrophotographic photosensitive member 4 was prepared by the same method as in Example 1 except that. Exemplary compound (1) used for the intermediate layer in Example 1 was replaced with Exemplary compound (11). The electrophotographic photosensitive member 4 was evaluated in the same manner as in Example 1. The results of evaluation are shown in Tables 1 and 2.

Example 5

An electrophotographic photosensitive member 5 was prepared by the same method as in Example 1 except that Exemplary compound (1) used for the intermediate layer an Example 1 was replaced with Exemplary compound (12). The electrophotographic photosensitive member 5 was evaluated in the same manner as in Example 1. The results of evaluation are shown in Tables 1 and 2.

Example 6

An electrophotographic photosensitive member 6 was prepared by the same method as in Example 1 except that Exemplary compound (1) used for the intermediate layer in Example 1 was replaced with Exemplary compound (15). The electrophotographic photosensitive member 6 was evaluated in the same manner as in Example 1. The results of evaluation are shown in Tables 1 and 2.

Example 7

An electrophotographic photosensitive member 7 was prepared by the same method as in Example 1 except that Exemplary compound (1) (8 parts), the copolymerized nylon resin (trade name: AMILAN CM8000, made by Toray Industries, Inc., 4 parts), and the methoxymethylated nylon 6 resin (trade name: TORESIN EF-30T, made by Nagase ChemteX Corporation, 8 parts) used for the Intermediate layer in Example 1 were replaced with Exemplary compound (1) (10 parts), the copolymerized nylon resin (trade name: AMILAN CM8000, made by Toray Industries, Inc., 3 parts), and methoxymethylated nylon 6 resin (trade name: TORESIN EF-30T, made by Nagase ChemteX Corporation, 7 parts). The electrophotographic photosensitive member 7 was evaluated in the same manner as in Example 1. The results of evaluation are shown in Tables 1 and 2.

Example 8

An electrophotographic photosensitive member 8 was prepared by the same method as in Example 1 except that the copolymerized nylon resin (trade name: AMILAN CM8000, made by Toray Industries, Inc., 3 parts) and the methoxymethylated nylon 6 resin (trade name: TORESIN EF-30T, made by Nagase ChemteX Corporation, 7 parts) used for the intermediate layer in Example 7 were replaced with a dimer acid-based polyamide resin (trade name: PA-105A, made by T&K, TOKA CO., LTD.), and the mixed solvent of methanol (250 parts)/n-butan (150 parts) was replaced with n-propanol (200 parts)/toluene (200 parts). The electrophotographic photosensitive member 8 was evaluated in the same manner as in Example 1. The results of evaluation are shown in Tables 1 and 2.

Example 9

An electrophotographic photosensitive member 9 was prepared by the same method as in Example 1 except that the crystalline hydroxygallium phthalocyanine (crystals containing 2.1% N,N-dimethylformamide relative to the amount of the hydroxy phthalocyanine compound) prepared in Preparative Example 1 used for charge generation layer in Example 1 and having peaks at 7.4° and 28.4° in the chart obtained by CuKα characteristic x-ray diffraction was replaced with the crystalline hydroxygallium phthalocyanine (crystals containing 1.7% N-methylformamide relative to the amount of the hydroxygallium phthalocyanine compound) prepared in Preparative Example 2 and having peaks at 7.4° and 28.3° in the chart obtained by CuKα characteristic X-ray diffraction. The electrophotographic photosensitive member 9 was evaluated in the same manner as in Example 1 The results of evaluation are shown in Tables 1 and 2.

Example 10

An electrophotographic photosensitive member 10 was prepared by the same method as in Example 1 except that the crystalline hydroxygallium phthalocyanine (crystals containing 2.1% N,N-dimethylformamide relative to the amount of the hydroxy phthalocyanine compound) prepared in Preparative Example 1 used for charge generation layer in Example 1 and having peaks at 7.4° and 28.4° in the chart was replaced with the crystalline hydroxygallium phthalocyanine (crystals containing 0.9% N-methylformamide relative to the amount of the hydroxygallium phthalocyanine compound) prepared in Preparative Example 3 and having peaks at 7.4° and 28.3° in the chart obtained by CuKα characteristic X-ray diffraction. The electrophotographic photosensitive member 10 was evaluated in the same manner as in Example 1. The results of evaluation are shown in Tables 1 and 2.

Comparative Example 1

A comparative electrophotographic photosensitive member 1 was prepared by the same method, as in Example 1 except that Exemplary compound (1) used for the intermediate layer in Example 1 was not added. The comparative electrophotographic photosensitive member 1 was evaluated in the same manner as in Example 1. The results of evaluation are shown in Tables 1 and 2.

Comparative Example 2

A comparative electrophotographic photosensitive member 2 was prepared by the same method as in Example 1 except that Exemplary compound (1) used for the intermediate layer in Example 1 was replaced with Comparative compound (1). The comparative electrophotographic photosensitive member 2 was evaluated in the same manner as in Example 1. The results of evaluation are shown in Tables 1 and 2.

Comparative compound (1)

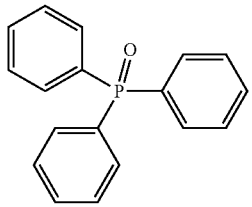

TABLE 1

| Example No./ | | | N/N | | | |
|---|---|---|---|---|---|---|
| | | | Initial | | After durability test to print 1000 sheets | |
| Comparative Example No. | Compound used for undercoat layer | Resin | Bright potential | Ghost Rank | Bright potential | Ghost Rank |
| Example 1 | Exemplary compound (1) | AMILAN/TORESIN | 100 | 2 | 110 | 2 |
| Example 2 | Exemplary compound (2) | AMILAN/TORESIN | 100 | 2 | 110 | 2 |
| Example 3 | Exemplary compound (9) | AMILAN/TORESIN | 100 | 2 | 110 | 2 |
| Example 4 | Exemplary compound (11) | AMILAN/TORESIN | 100 | 2 | 110 | 2 |
| Example 5 | Exemplary compound (12) | AMILAN/TORESIN | 100 | 2 | 110 | 2 |
| Example 6 | Exemplary compound (15) | AMILAN/TORESIN | 100 | 2 | 110 | 2 |
| Example 7 | Exemplary compound (1) | AMILAN/TORESIN | 100 | 1 | 110 | 2 |
| Example 8 | Exemplary compound (1) | PA-105A | 100 | 1 | 110 | 2 |

TABLE 1-continued

| Example No./ | | | N/N | | | |
|---|---|---|---|---|---|---|
| | | | Initial | | After durability test to print 1000 sheets | |
| Comparative Example No. | Compound used for undercoat layer | Resin | Bright potential | Ghost Rank | Bright potential | Ghost Rank |
| Example 9 | Exemplary compound (1) | AMILAN/TORESIN | 100 | 1 | 110 | 2 |
| Example 10 | Exemplary compound (1) | AMILAN/TORESIN | 100 | 1 | 110 | 2 |
| Comparative Example 1 | — | AMILAN/TORESIN | 100 | 4 | 120 | 5 |
| Comparative Example 2 | Comparative compound (1) | AMILAN/TORESIN | 100 | 3 | 120 | 4 |

TABLE 2

| Example No./ | L/L | | | | H/H | | | |
|---|---|---|---|---|---|---|---|---|
| | Initial | | After durability test to print 1000 sheets | | Initial | | After durability test to print 1000 sheets | |
| Comparative Example No. | Bright potential | Ghost Rank | Bright potential | Ghost Rank | Bright potential | Ghost Rank | Bright potential | Ghost Rank |
| Example 1 | 115 | 2 | 130 | 3 | 100 | 3 | 100 | 3 |
| Example 2 | 110 | 2 | 130 | 3 | 100 | 3 | 100 | 3 |
| Example 3 | 110 | 2 | 130 | 3 | 95 | 3 | 100 | 3 |
| Example 4 | 115 | 2 | 140 | 3 | 130 | 3 | 125 | 3 |
| Example 5 | 115 | 3 | 140 | 3 | 125 | 3 | 125 | 3 |
| Example 6 | 110 | 2 | 120 | 3 | 115 | 3 | 120 | 3 |
| Example 7 | 110 | 2 | 120 | 3 | 110 | 3 | 110 | 3 |
| Example 8 | 100 | 1 | 110 | 2 | 100 | 2 | 100 | 2 |
| Example 9 | 115 | 1 | 120 | 2 | 100 | 2 | 100 | 2 |
| Example 10 | 115 | 1 | 120 | 1 | 100 | 2 | 100 | 2 |
| Comparative Example 1 | 125 | 5 | 175 | 6 | 140 | 6 | 150 | 6 |
| Comparative Example 2 | 125 | 4 | 155 | 5 | 135 | 5 | 150 | 5 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-209160, filed Oct. 23, 2015, which is hereby incorporated by reference herein in its entirety.

What is claimed is:

1. An electrophotographic photosensitive member comprising, in this order:

an electroconductive support, an intermediate layer, a charge generation layer containing a charge generation material, and a charge transport layer containing a charge transport material, the intermediate layer containing a resin, and a compound having two or more diarylphosphine oxide structures.

2. The electrophotographic photosensitive member according to claim 1, wherein the compound having two or more diarylphosphine oxide structures is a compound represented by formula (1):

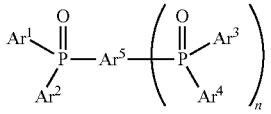

(1)

wherein $Ar^1$ to $Ar^4$ each independently represent an aromatic hydrocarbon group having an optional substituent; and n represents 1 or 2, and when n is 1, $Ar^5$ represents a divalent aromatic hydrocarbon group having an optional substituent, and when n is 2, $Ar^5$ represents a trivalent aromatic hydrocarbon group having an optional substituent; and the optional substituent of the aromatic hydrocarbon group in $Ar^1$ to $Ar^5$ is a halogen atom, an alkyl group having 1 to 4 carbon atoms, a methoxy group, an ethoxy group, a dimethylamino group, a diethylamino group, or a diphenylphosphine oxide group.

3. The electrophotographic photosensitive member according to claim 2, wherein $Ar^5$ is a terphenylene group.

4. The electrophotographic photosensitive member according to claim 1, wherein the resin is a polyamide resin.

5. The electrophotographic photosensitive member according to claim 4, wherein the polyamide resin is a polyamide resin containing a dimer acid residue having 36 to 44 carbon atoms as a dicarboxylic acid component.

6. The electrophotographic photosensitive member according to claim 1, wherein the mass ratio of the content of the compound having two or more diarylphosphine oxide structures to the content of the resin in the intermediate layer is 2:8 to 6:4.

7. The electrophotographic photosensitive member according to claim 1, wherein the charge generation material is gallium phthalocyanine crystal.

8. The electrophotographic photosensitive member according to claim 7, wherein the gallium phthalocyanine crystal is hydroxygallium phthalocyanine crystal having peaks at 7.4°±0.3° and 28.3°±0.3° in CuKα characteristic X-ray diffraction pattern (Bragg angle 2θ).

9. The electrophotographic photosensitive member according to claim 8, wherein the hydroxygallium phthalocyanine crystal having peaks at 7.4°±0.3° and 28.3°±0.3° in CuKα characteristic X-ray diffraction pattern (Bragg angle 2θ) contains N,N-dimethylformamide and/or N-methylformamide in the crystal.

10. The electrophotographic photosensitive member according to claim 9, wherein the total content of N,N-dimethylformamide and/or N-methylformamide contained in the gallium phthalocyanine crystal is 0.5 mass % or more and 1.7 mass % or less of gallium phthalocyanine in the gallium phthalocyanine crystal.

11. A process cartridge integrally supporting the electrophotographic photosensitive member, and at least one unit selected from the group consisting of a charging unit, a developing unit, and a cleaning unit, and detachably mountable on a main body of an electrophotographic apparatus, the electrophotographic photosensitive member comprising, in this order, an electroconductive support, an intermediate layer, a charge generation layer containing a charge generation material, and a charge transport layer containing a charge transport material, the intermediate layer containing a resin, and a compound having two or more diarylphosphine oxide structures.

12. An electrophotographic apparatus comprising an electrophotographic photosensitive member, a charging unit, an exposing unit, a developing unit, and a transferring unit, the electrophotographic photosensitive member comprising, in this order, an electroconductive support, an intermediate layer, a charge generation layer containing a charge generation material, and a charge transport layer containing a charge transport material, the intermediate layer containing a resin, and a compound having two or more diarylphosphine oxide structures.

* * * * *